US006029615A

United States Patent [19]

Terwilliger et al.

[11] Patent Number: 6,029,615

[45] Date of Patent: Feb. 29, 2000

[54] WATER HEATER CONSTRUCTION AND FABRICATION METHOD THEREFOR

[75] Inventors: R. James Terwilliger, Pegram; Gordon D. Shippy, Clarksville; Otto Z. Vago, Burns, all of Tenn.

[73] Assignee: State Industries, Inc., Ashland City, Tenn.

[21] Appl. No.: 09/000,503

[22] Filed: Dec. 30, 1997

[51] Int. Cl.[7] ..... F22B 37/36

[52] U.S. Cl. ..... 122/494; 264/46.9; 220/592.24; 220/694.1

[58] Field of Search ..... 122/494, 13.1; 264/46.2, 46.5, 46.6, 46.9; 220/592.24, 694.1

[56] References Cited

U.S. PATENT DOCUMENTS 4,527,543 7/1985 Denton ..... 122/494
4,861,968 8/1989 West ..... 264/46.9
5,023,031 6/1991 West et al. ..... 264/46.5
5,474,202 12/1995 Moore, Jr. ..... 220/444

*Primary Examiner*—Teresa Walberg
*Assistant Examiner*—Gregory A. Wilson
*Attorney, Agent, or Firm*—Paul R. Puerner

[57] ABSTRACT

A water heater including a tank, a cylindrical jacket surrounding the tank to provide an insulating space therebetween and a cover member mounted on top of the jacket to close off the top of the insulating space. An insulating wall is provided in the insulating space between the tank and the jacket. The insulating wall is comprised of a plastic envelope member and a wall of insulating material which has been foamed-in-place inside the envelope member. The envelope is constructed in such a way as to evenly distribute the foam material inside the envelope during the foamed-in-place operation.

4 Claims, 3 Drawing Sheets

WATER HEATER CONSTRUCTION AND FABRICATION METHOD THEREFOR

BACKGROUND OF THE INVENTION

1. Field of the Invention

This invention relates to water heater constructions and a method of water heater fabrication and more particularly to a novel method of insulating the exterior of the water heater tank.

2. Description of the Prior Art

The subject matter of this invention is an improvement and refinement of the foam-insulated water heater construction and fabrication method shown in U.S. Pat. Nos. 4,447,377 and 4,527,543.

BRIEF SUMMARY OF THE INVENTION

A water heater including a tank and a jacket surrounding the tank and spaced therefrom to provide an insulating space therebetween. An insulating wall is provided in the insulating space. Such wall includes a plastic envelope member and a wall of rigid polyurethane foam insulating material which has been foamed-in-place inside the envelope member. The envelope member of the present invention is provided with window openings and an intermittent vertically extending seal which serves to provide uniform distribution of the pressure of the polyurethane foam insulation material as it is introduced into the envelope. The envelope is constructed in such a way as to evenly distribute the foam material inside the envelope during the foam-in-place operation. More specifically, the envelope is provided with a vertically extending intermittent partial seal which serves to evenly distribute the pressure of foam material when it is injected into the top portion of the envelope when the envelope is positioned inside the jacket between the tank wall and the jacket of the water heater.

BRIEF DESCRIPTION OF THE SEVERAL VIEWS OF THE INVENTION

DETAILED DESCRIPTION OF THE INVENTION

Figure 1:
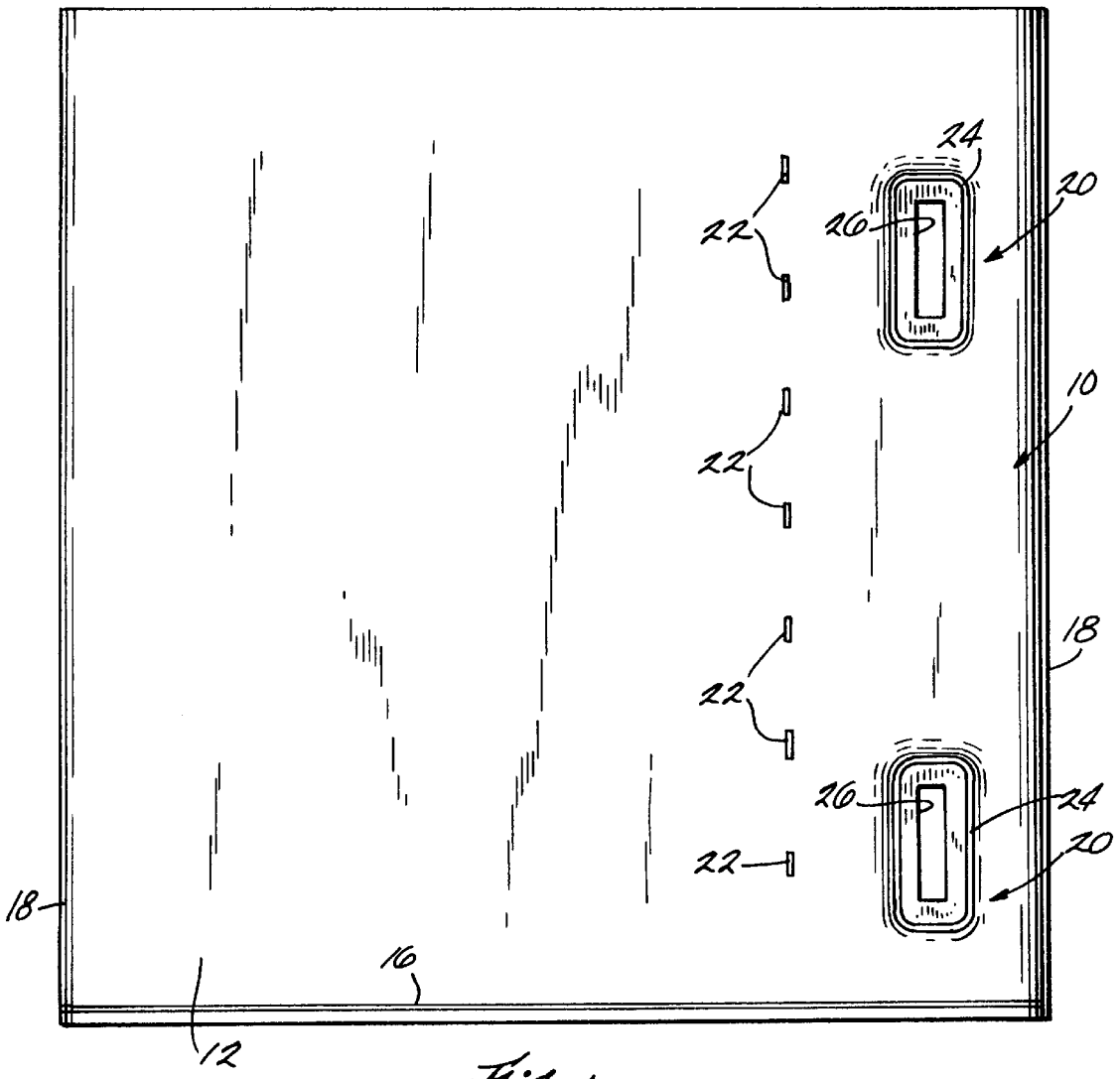
FIG. 1 is a side elevation view of the plastic envelope member of the present invention before the envelope is installed in a water heater.
Figure 2:
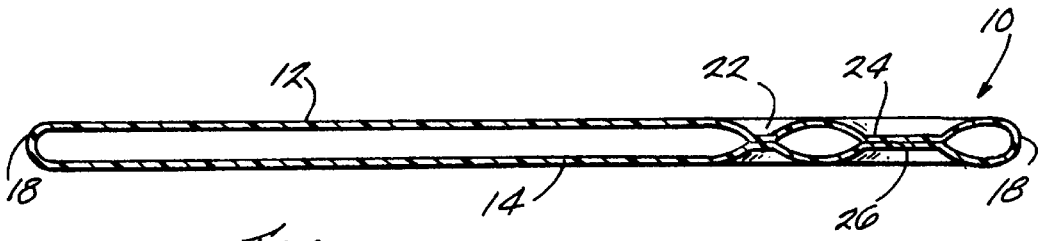
FIG. 2 is a top plan view of the envelope member shown in FIG. 1.

Referring to the drawings in detail, FIGS. 1 and 2 show one embodiment of a plastic envelope 10 designed for use in the present invention.

Envelope 10 is made of a suitable plastic material such as polyethylene.

Envelope 10 is in the form of an elongated relatively thin tube having an inner wall 12 and an outer wall 14.

The envelope is sealed along the bottom as indicated by reference numeral 16.

As shown in FIGS. 1 and 2, the envelope 10 is partially flattened prior to installation in a water heater. The envelope 10, when partially flattened (FIG. 2), has end walls 18, 18 at opposite ends thereof.

The envelope is further provided with one or more access windows 20, 20 and a plurality of intermittent vertically spaced seals 22.

Figure 5:
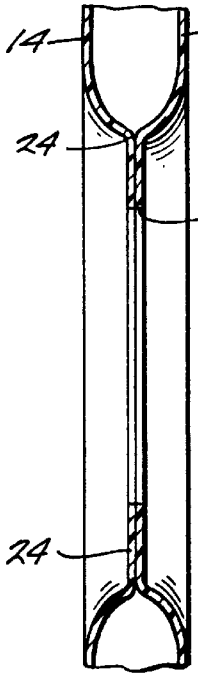
FIG. 5 is a sectional view taken along line 5—5 of FIG. 1.

Windows 20, 20 are formed by rectangular seals 24,24 and a cut-out portion 26 within each seal area as shown in FIG. 5.

Vertically spaced intermittent seals 22 connect inner and outer walls 12, 14 as shown in FIG. 2.

In a first embodiment, envelope 10 is made from tubular material cut to the desired length. One end of the tube is sealed to provide the bottom seal 16 as shown in FIG. 1. Preferably the seal is made by a radio frequency welding procedure.

With the envelope in a flattened condition as shown in FIG. 2, window seals 24 and intermittent seal areas 22 can be made by a radio frequency welding procedure. Cut-out openings 26 are then made by a suitable cutting tool to complete the envelope as shown in FIGS. 1 and 2.

Figure 4:
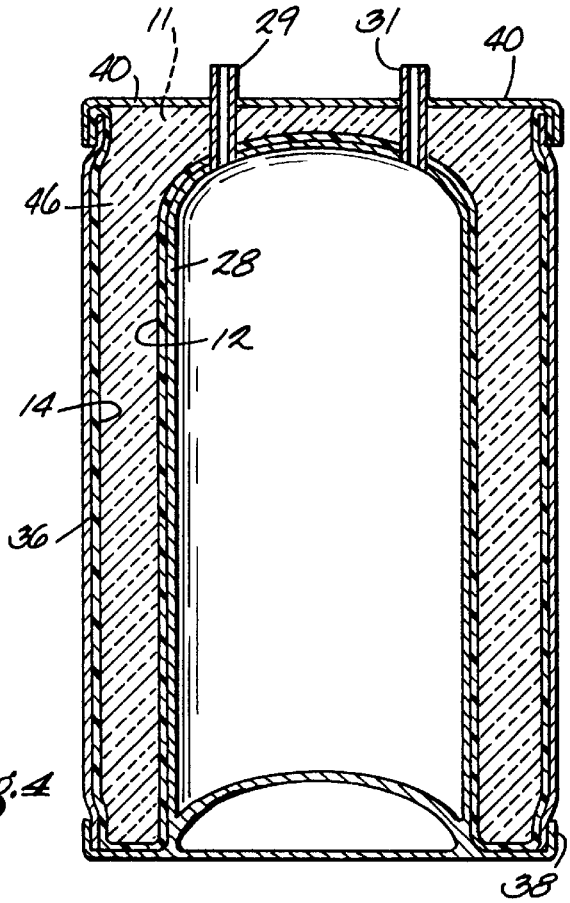
FIG. 4 is a vertical section view of an electric water heater as shown in FIG. 3 but with the jacket and cover in assembled position.

The foamed-in-place insulating wall for a water heater tank 28 is provided by following a step-by-step method which will now be described. Tank 28 has hot and cold water outlet and inlet nipples 29, 31 as shown in FIG. 4.

Figure 3:
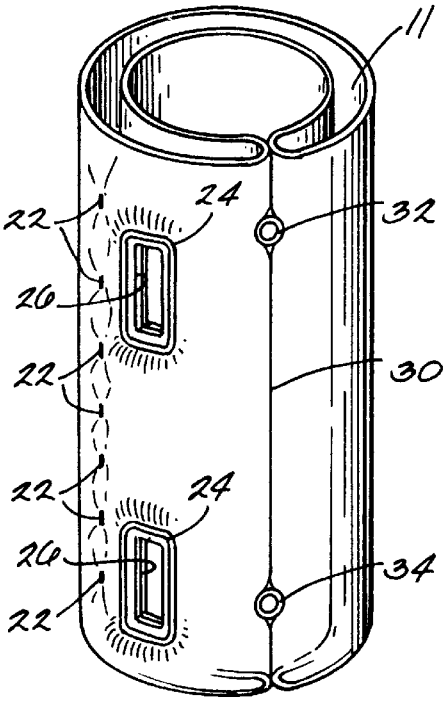
FIG. 3 is a perspective view showing the envelope of the present invention wrapped around the tank of an electric water heater before the jacket and cover are installed.

Referring to FIG. 3, the first step is to wrap the plastic envelope 10 around the tank. As explained above, envelope 10 is in the form of an elongated relatively thin tube having an inner wall 12 and an outer wall 14 and narrow end walls 18,18 produced at the folded area between walls 12 and 14.

The vertical height of envelope 10 is dimensioned so that it extends a short distance above the top of tank 28 as best shown in FIG. 3. Also as shown in FIG. 3, envelope 10 is positioned on tank 28 so that the end walls 18,18 abut each other along a vertical line 30 which passes around fittings 32 and 34 on the side of the tank 28. The envelope can be retained in its FIG. 3 position on the outside of tank 28 by the use of a suitable adhesive.

The next step is to install a metal outer jacket 36 over the envelope 10. Jacket 36 cooperates with a base member 38 to close off the space between the tank wall and the jacket. The top portion of outer envelope wall 14 is folded down around the outside of jacket 36 and the top portion of inner envelope wall 12 is folded down so that it will lie across the top of tank 28 as shown in FIG. 4.

The next step is to install a metal cover member 40*c* (FIG. 6) on the top of jacket 36 to thereby close off the top of the jacket. The installation of cover 40*c* will capture the top folded down portion of wall 14 between the cover 40*c* and the jacket 36.

Figure 6:
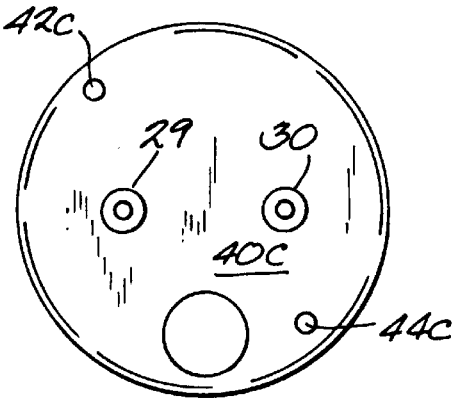
FIG. 6 is a top plan view of the jacket cover.

The next step is to inject a foam-type insulation material into the envelope 10 through its open top 11. A top plan view of cover member 40*c* is shown in FIG. 6. This is accomplished by introducing the foam components (in liquid form) through openings 42*c*, 44*c* in cover member 40*c*. Cover member 40*c* is also provided with separate vent holes (not shown) which serve as air vents during the foam operation and also serve to provide a visual indicator for checking to verify that the envelope 10 is completely filled. After the foam injection step is completed, the injector and vent openings are plugged by suitable plastic plugs (not shown). As shown in FIG. 6, front foam hole 42*c* is located approximately 45–50° to the left and above the horizontal center line. The foam hole 44*c* is located approximately 45–50° to the right and below the horizontal center line. The foam holes are located approximately 0.25 inches from the edges of the cover member 40*c*.

Within a relatively short period of time, the foam material will set to thereby provide a rigid wall 46 of foam insulation material around the tank 28.

In one preferred embodiment, the foamed components are injected into the open top of envelope 10 in the area above to the right of the upper window 20 as shown by the arrows in FIG. 1. FIG. 1 is referred to in describing the flow into the envelope with the understanding that the position of the envelope during foam injection will be when it is positioned around the tank as shown in FIG. 3. The reference to FIG. 1 is only to more clearly describe the flow as the material fills the envelope.

The flow entering the open top of the envelope will flow downwardly to the envelope bottom and outwardly and upwardly around the tank in the envelope. The foam flowing to the left as shown in FIG. 1 will necessarily flow between intermittent seals 22. The presence of seals 22 will restrict flow to the left which in turn will equalize the expansion pressures of the foam in the envelope. The flow will thus be balanced so that flow into the envelope will be evenly distributed throughout the interior of the envelope, i.e., the flow of foam will reach the far right end of the envelope at about the same time as the flow will completely fill the space around the top and bottom windows 20. The foam entering the envelope will thereby rise to the top evenly around the entire circumference of the tank 28. A uniform, fully formed wall of insulation in the entire envelope will result.

The folded down portion of envelope wall 14 is cut off around the end of top member 40*c*. The injection of the foam material into the envelope 10 will cause the end walls 18,18 to be forced into abutting engagement with each other and into tight contact with any tank connections 32, 34 located along vertical abutting line 30.

As an alternative, foam can be introduced into open top 11 of envelope 10 with the cover 40*c* off. Cover 40*c* is immediately installed on the jacket 36 after the foam injection step is completed.

In a preferred embodiment of the present invention, the envelope 10 is made from polyethylene or other suitable material. Also in the preferred embodiment, the foam material is a closed cell rigid polyurethane foam having an insulative gas captured in the closed cells thereof. While various specific formulations can be used a typical formulation is comprised of two basic components, namely, resin and isocyanate. The resin is a mixture of polyol, a catalyst, a silicone surfactant and a blowing agent. Isocyanate is a chemical compound, e.g., diphenylmethane diisocyanate. The blowing agent is a hydro fluorocarbon or other suitable compound, e.g., 141B. The blowing agent in the resin is in liquid form and when combined in the foam machine with isocyanate, the resulting exotherm converts the 141B to a gaseous state, which becomes encapsulated within the cellular structure of the rigid foam material. The equipment for mixing and injecting the foam components is well known in the art and thus will not be described herein.

Figure 10:
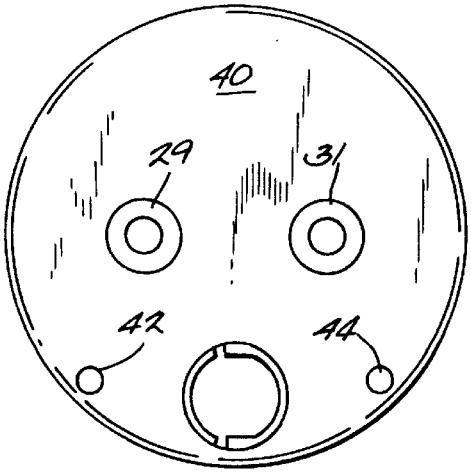
FIG. 10 is a top plan view of a jacket cover having an alternate construction.
Figure 7:
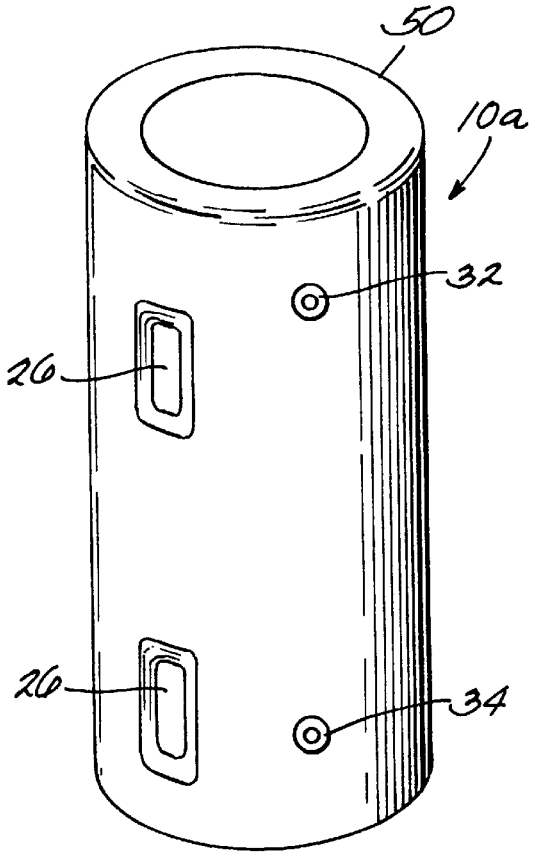
FIG. 7 is a perspective view showing a second embodiment of an envelope wrapped around the tank of an electric water heater before the jacket and cover are installed.

A second embodiment of the present invention is shown in FIGS. 7 and 10. In this embodiment, the intermittent seal areas 22 are eliminated and the envelope 10*a* is overlapped as indicated by reference numeral 50. Preferably, the overlap 50 is located directly opposite the cut out opening 26, i.e., approximately 180° from cut outs 26.

Tank fittings 32, 34 extend through openings in the walls of envelope 10*a*.

The foam insulation material is injected into envelope 10*a* through openings 42, 44 in jacket cover 40 as shown in FIG. 10. The foam will fill envelope 10*a* in a balanced and uniform manner and as it sets will press the overlapped ends of envelope 10*a* firmly together. The openings 42, 44 are located approximately 0.25 inches from the edges of the cover 40 and 45–50° to the left and right below the horizontal center line.

Figure 9:
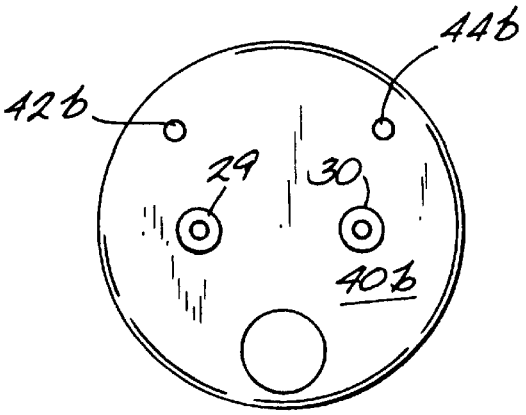
FIG. 9 is a top plan view of a jacket cover having an alternate construction.

FIG. 9 shows an alternate jacket cover 40*b* having foam injection openings 42*b*, 44*b*. Openings 42*b*, 44*b* are located approximately 45–50° above the horizontal center line of the FIG. 9 cover 40*b*. Openings 42*b*, 44*b* are located approximately 0.25 inches from the edges of the cover 40*b*.

Figure 8:
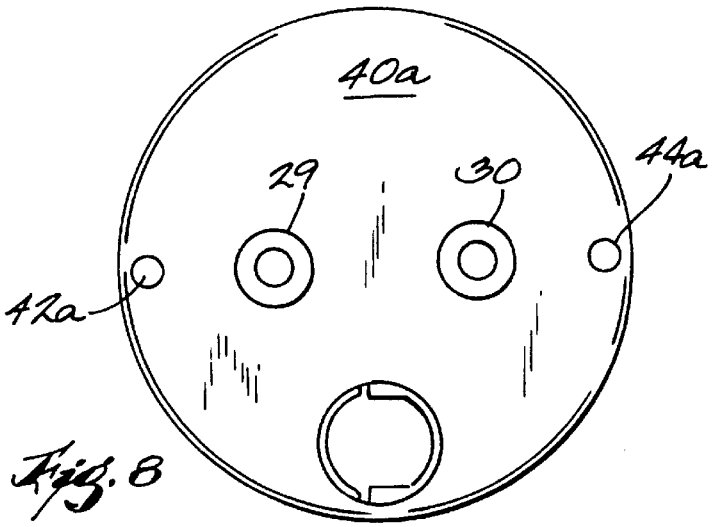
FIG. 8 is a top plan view of a jacket cover having an alternate construction.

FIG. 8 shows an alternate jacket cover 40*a* having foam injection openings 42*a*, 44*a*. As shown in FIG. 8, the injection openings 42*a*, 44*a* are located on the horizontal center line as viewed in FIG. 8. The openings 42*a*, 44*a* are located approximately 0.25 inches from the edges of the cover 40*a*.

While the invention has been herein shown and described in what is presently conceived to be the most practical and preferred embodiment, it will be obvious to one of ordinary skill in the art that modifications may be made thereof within the scope of the invention, which scope is not to be limited except by the appended claims.

We claim:

1. A water heater comprising:

(1) a tank means;

(2) a jacket means surrounding said tank means and spaced therefrom to provide an insulating space therebetween, said jacket means including a cylindrical jacket member, a base member and a cover member mounted on the top of said jacket member to close off the top of the insulating space; and (3) an insulating wall means mounted in said insulating space, said insulating wall means including an envelope member in the form of an elongated, relatively thin tube having an inner wall, an outer wall and a bottom wall, and a pair of end walls, said end walls positioned in an abutting relationship with each other, said envelope further provided with a plurality of intermittent, vertically spaced seal areas, said seal areas adapted to control flow of foam material into said envelope during the fabrication of the water heater, said insulating space between said inner and outer tubular walls having a one-piece cylindrical wall of insulating material which has been foamed in place entirely inside the envelope member, said insulating wall material comprised of a closed cell rigid polyurethane foam material having gas captured in the closed cells thereof.

2. A water heater according to claim 1 in which said envelope member is further characterized by at least one cut-out opening therein to provide access to a component mounted on the wall of the tank.

3. A water heater comprising:

(1) a tank means;

(2) a jacket means surrounding said tank means and spaced therefrom to provide an insulating space therebetween, said jacket means including a cylindrical jacket member, a base member and a cover member mounted on the top of said jacket member to close off the top of the insulating space;

(3) an insulating wall means mounted in said insulating space, said insulating wall means including an envelope member in the form of an elongated, relatively thin tube having an inner wall, an outer wall and a bottom wall, said envelope having a pair of end walls overlapping each other, said envelope further provided with a plurality of cut out portions, said cut out portions located directly opposite the overlap, approximately 180° from the overlap, said insulating space between said inner and outer tubular walls having a one-piece cylindrical wall of insulating material which has been foamed in place entirely inside the envelope member, said overlapping end walls being pressed firmly together as said insulating material becomes foamed in place inside the envelope member, said insulating wall material comprised of a closed cell rigid polyurethane foam material having gas captured in the closed cells thereof; and (4) said cover member having a pair of injection openings located approximately 0.25 inches from the edges of the cover member and located directly opposite from each other across a diameter of the cover member.

4. A water heater comprising:

(1) a tank means;

(2) a jacket means surrounding said tank means and spaced therefrom to provide an insulating space therebetween, said jacket means including a cylindrical jacket member, a base member and a cover member mounted on the top of said jacket member to close off the top of the insulating space;

(3) an insulating wall means mounted in said insulating space, said insulating wall means including an envelope member in the form of an elongated, relatively thin tube having an inner wall, an outer wall and a bottom wall, said envelope having a pair of end walls overlapping each other, said envelope further provided with a plurality of cut out portions, said cut out portions located directly opposite the overlap, approximately 180° from the overlap, said insulating space between said inner and outer tubular walls having a one-piece cylindrical wall of insulating material which has been foamed in place entirely inside the envelope member, said overlapping end walls being pressed firmly together as said insulating material becomes foamed in place inside the envelope member, said insulating wall material comprised of a closed cell rigid polyurethane foam material having gas captured in the closed cells thereof; and (4) said cover member having a pair of injection openings located approximately 0.25 inches from the edges of the cover and located approximately 45–50° above the horizontal center line of the cover.

* * * * *